United States Patent [19]

Higuchi et al.

[11] Patent Number: 4,525,169

[45] Date of Patent: Jun. 25, 1985

[54] ARTIFICIAL GRAIN LEATHER HAVING DIFFERENT COLOR SPOT GROUPS

[75] Inventors: Akira Higuchi, Otsu; Miyoshi Okamoto, Takatsuki, both of Japan

[73] Assignee: Toray Industries, Inc., Tokyo, Japan

[21] Appl. No.: 510,887

[22] Filed: Jul. 5, 1983

[30] Foreign Application Priority Data

Jul. 8, 1982 [JP] Japan ..... 57-118969
May 16, 1983 [JP] Japan ..... 58-84198

[51] Int. Cl.[3] ..... D06N 3/04; D06N 3/18; D06P 3/86; D06P 3/87

[52] U.S. Cl. ..... 8/485; 8/114.6; 8/529; 8/531; 428/91; 428/151; 428/171; 428/172; 428/203; 428/286; 428/287; 428/290; 428/904

[58] Field of Search ..... 428/284, 287, 91, 904, 428/290, 151, 171, 172, 286, 203; 8/485, 114.6, 529, 531

[56] References Cited

U.S. PATENT DOCUMENTS 4,051,287 9/1977 Hoyashi et al. ..... 428/91
4,103,054 7/1978 Okamoto et al. ..... 428/91
4,145,468 3/1979 Miyoguchi et al. ..... 428/284
4,146,663 3/1979 Ikeda et al. ..... 428/284
4,241,122 12/1980 Asano ..... 428/904
4,318,949 3/1982 Okamoto et al. ..... 428/91
4,352,705 10/1982 Oyaki et al. ..... 428/91
4,368,227 1/1983 Setsuie et al. ..... 428/91

*Primary Examiner*—James C. Cannon
*Attorney, Agent, or Firm*—Austin R. Miller

[57] ABSTRACT

The present invention relates to an artificial grain leather having different color spot groups comprised of ultra fine fibers, in which at least one side of the fibrous substrate has two types of colors differing in hue and/or lightness value and being covered with transparent resin layers.

The present invention produces a three-dimensional surface effect and a grain pattern effect, and is recognized as consisting of a mixture of ultra fine fibers each being quite different in color from the next, though providing the appearance of a single color from a distance, and producing a subdued and rich appearance as a result of the integration of colors by the color of a coating layer.

12 Claims, 6 Drawing Figures

ARTIFICIAL GRAIN LEATHER HAVING DIFFERENT COLOR SPOT GROUPS

BACKGROUND OF THE INVENTION

1. Field of the Invention

The present invention relates to an artificial grain leather consisting of a fibrous substrate and coating layer, said fibrous substrate composing of ultra fine fiber, having at least two kinds with different color hues and/or lightness shades and being coated on at least one side of it by transparent resins.

2. Description of the Prior Art

Recent development of an artificial grain leather has progressed remarkably. Much efforts are being made to obtain an artificial leather the grained surface of which more closely resembles that of natural leather consisting of ultra fine fibers, and to correct the defects in natural leather. A leather is needed which is more agreeable to the touch than natural leather; or a leather having more sophisticated coloring which has not been obtained by the conventional artificial grain leather or natural leather which is single-tone colored; a leather of higher quality and subdued color; a leather of coloring not achievable with the print dying, in particular, due to pores and an artificial leather whose feel is that of the natural grain leather which is obtained without embossing.

Further, in conventional artificial grain leathers, the coated surface has been shaded by applying a deep colored composition directly to the monochromatic coating using a print roll. Thus, conventional artificial grain leathers have disadvantages, such as lack of impressiveness in colors, restricted color variety, lack of cubical appearance, and poor color fastness because it can easily become discolored by surface friction, heat, or solvents.

SUMMARY OF THE INVENTION

An object of the present invention is to provide an artificial grain leather with a high grade appearance having a superior grain pattern effect and a three-dimensional surface effect. The term "three-dimensional surface effect" means a surface which has the appearance of depth and unevenness due to different color spot groups.

Another object of the present invention is to provide an artificial grain leather having different color spot groups, which looks like a single color at a distance but which can be discerned up close as a mixture of entirely differently colored ultra fine fibers and which gives an impression of richness created by overlapping their colors on the surface.

A further object of the present invention is to provide an artificial grain leather presenting as entirely new tint with quality appearance and having different color spot groups, all of which cannot be attained by a natural leather.

A still further object of the present invention is to provide an artificial grain leather having high strength and vivid color.

DESCRIPTION OF THE PREFERRED EMBODIMENTS

Figure 1:
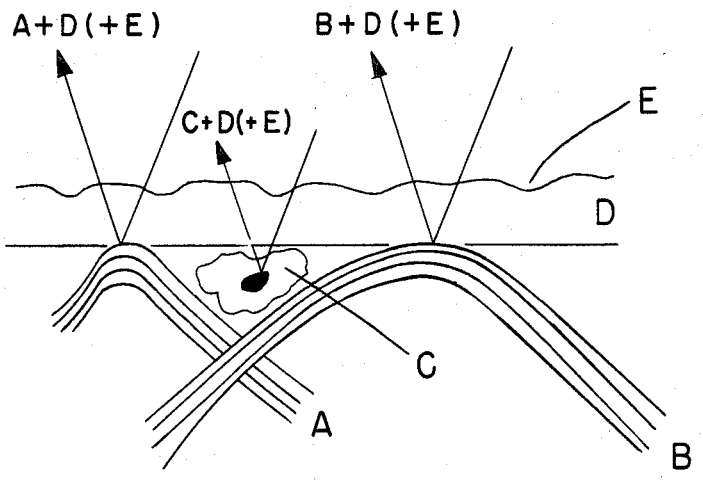
FIG. 1 shows a model of the surface cross section of an artificial grain leather having different color spot groups provided by the present invention.

The fibrous substrate of the present invention is composed of ultra fine fibers which are not more than about 0.7 denier, preferably between about 0.0001 and about 0.3 denier, or ultra fine fiber bundles comprising chiefly such ultra fine fibers. The fibrous substrate of the present invention exhibits the unique and rich appearance of high grade color, touch and hand, because of the synergistic effect of the composition provided by blending ultra fine fibers as mentioned above.

To produce the ultra fine fibers used in the present invention, a conventional process may be used. The method includes, for example, that of making the ultra fine fibers by a suitable means from multicomponent fibers such as islands-in-a-sea type composite fibers, high molecular inter-arrangement fibers, stripped-off type (rice type, chrysanthemum type, ribbon type, etc.,) composite fibers, special polymer-blended type fibers, etc. The making of such ultra fine fibers for the present invention includes but is not limited to chemical and physical means which are generally employed, such as dissolution, decomposition, and decortication of one component among other components, etc. Other means to be used include for examples super-draw spinning, strong blowing spinning with air, and star-cloud type.

The details are referred to in, for example, the "Chemical Fiber Monthly Bulletin" July issue, 1977.

The cross sectional shapes of the fiber to be used include round cross section which is the most common, as well as any other shape such as a fan-shaped triangles, fan-shaped frustums, rectangles, cross-shapes, T-shaped triangles, Japanese rice ball-shaped triangles, and other multi-lobar shapes, various kinds of shapes with n-lobes and n-processes (n is an integer), hollow shapes, deformed hollow shapes and ellipses.

The word "comprising chiefly of" used in the foregoing description includes the cases where fibers of large denier above the defined limit are mixed to such an extent that there is no substantial influence on the functional effect of the present invention, and foreign substances such as additives are applied to the fibers. The word implies, for example, that a very large amount of ultra fine fibers may contain small amounts of thicker fibers of not less than 0.7 denier. There are also some cases in which, in making ultra fine fibers by stripping off the stripped-off type multi-component fibers, another component lying between the ultra fine fiber components remains as thick deformed cross section yarn, or the multi-component type fiber itself being capable of producing ultra fine fibers remains as a larger fiber without being changed into ultra fine fibers. A further implication is that, even in the above case, if the portion of the unchanged remaining large fiber does not exceed the greater part of the whole fiber, the object of the present invention can adequately be achieved. In any case, any variation within this limitation which does not cause a loss of the functional effect required by the present invention may be included in the present invention.

The fibrous substrate sheet used in the present invention is composed of knitting, unwoven fabric such as needle-punched felt and woven fabric, at least one side of which has the above-mentioned grained surface.

Methods for producing the fibrous substrate sheet are virtually limitless. When one side of the fibrous substrate is to have a nap, the substrate used is a nappy knit or fabric such as velveteen, corduroy, blanket, double velvet fabric, velvet, etc. After the sheet is formed, methods of raising the nap include those used in the manufacture of similar fabrics including abrasion with raising fillets or emery, buffing, loop-cut or electric placement of the nap.

The fibrous substrate of the present invention may contain various kinds of conventional high molecular viscoelastic substances such as polyurethane, acrylic resin and vulcanized silicone rubber.

One feature of the fibrous substrate of the present invention is the multicolor dyeing of the substrate comprising bundles of ultra fine fibers or between adjacent bundles, which constitute it. The above multicolor dyeing is achieved by using at least two types of ultra fine fiber material with different dyeability and dyeing each of them with different types of dyestuff.

The ultra fine fibers are classified by the differences in dyeability into dyeable fibers with disperse, acidic, basic, direct and reactive dyestuff. A combination of at least two types of fiber may be selected from the above-mentioned group. In the present invention which involves for the most part ultra fine fibers, the use of a small amount of common fibers mixed as the other fiber different in dyeing capabilities is included provided that a mixed color effect can be produced.

Examples of the dyeable fibers with disperse dyestuff include polyethylene terephthalate, polyoxyethylene benzoate, polybutylene terephthalate, or these substances whose copolymerization is modified to a greater or lesser extent or a blend formed by mixing with a modifying agent, polyamides with a rigid structure.

Examples of the dyeable fibers with acidic dyestuff involve polyamides having amino end group such as the familiar nylon 6, 66, 610 12 PACM.

Examples of the dyeable fibers with basic dyestuff are substances having—$SO_3$ Me (Metal) group, especially—$SO_3$ Na group or combinations.

Typical polymers for fibers of the above group are polyacrylonitrile type copolymerization polymer, polyethylene terephthalate or polybutylene terephthalate polymer copolymerized with sodium sulfoisophthalate, or mixed, etc.

As to the dyeable fibers with direct or reactive dyestuff, which may be ones containing a reactive group, typical are the fibers having—OH group such as cellulose or polyvinyl alcohol type. All the above fibers are of conventional ones, but substances other than the above may, of course, also be used.

A combination of at least two types of fiber selected from the above group is used to form the fibrous substrate. Methods of combining these include those given in the following examples:

Two types of multi-component type fiber are used,—those capable of producing bundles of ultra fine fibers consisting of island components by removing sea components, the island components of said fibers differing in dyeability from each other. The foregoing fibers are subjected to blending or mix spinning, and the resultant mixed spun yarn, web or filament is to produce the fibrous substrate. In this case, instead of a multi-component type fiber, bundles of initially very fine fibers which can be obtained by the super draw process, may be blended or mix-spun.

An example of the present invention includes combining high molecular arrangement fiber of the dyeable islands-in-a-sea type fiber with disperse dyestuff with high molecular arrangement fiber of the dyeable islands-in-a-sea type fiber with basic dyestuff. An example of the former island polymer is polyethylene terephthalate, and an example of the latter is polyethylene terephthalate copolymerized with sodium sulfoisophthalate.

A further example includes a mixture with the islands-in-a-sea type high molecular arrangement fiber whose island component is nylon 6 (the acid dyeable type containing many amino end groups).

The combining ratio (the ratio of each island component) may be selected optionally, and may range from about 1 to about 99% depending on the purpose to be achieved. The range of about 5 to about 95% creates an outstanding effect. In general, a preferred effect often results from a choice of the proportion of not more than about 50% of the fiber that has the deepest color. Especially, when the deep-colored fiber is mixed in a low proportion, the mixed part produces pores effect, which further enhance, the effect of the present method. When the deep-colored is mixed in a high proportion, then a gradation effect results.

With the multi-component fiber used in the present invention, it is not necessary that the island component to be perfectly enclosed by the sea component. The so-called split or stripped-off multi-component fiber, in which the both components adhere to each other in parallel, may be employed. In any case, the sea component is removed, and at least the island component or the component corresponding to the island component is principally utilized.

When the multi-component fiber is used, making the ultra fine fiber is carried out for an appropriate period of time before or after the formation of the sheet, preferably after the formation of the sheet in the present invention. This is reasons of good processability and obtaining a soft fibrous substrate.

When common fibers are mixed, it is necessary to control the proportion such that the common fibers never constitute the main part. Particularly, in the case of making raised nap on one side of the fibrous substrate, the proportion of common fibers is preferably limited to less than about 20%, more preferably not more than about 10%, taking into consideration the touch and hand, and the reversible lie of the nap, etc.

In any case, exceptional effects such as touch and hand, luster, the combination with color of the grained surface coating, and additionally coloration of binder, which should not be defined merely as common multicolor mixing, are obtained due to the unique effect of the ultra fine fibers. The treatment for making ultra fine fibers, which involves making a suitable selection, is necessary only when the multi-component fiber used is not yet ultra fine. In some kinds of multi-components fibers, it is possible to carry out the treatment for making ultra fine fibers and the dyeing, simultaneously. The dyeing may be carried out in the same way as for dyeing of staple, filament or fibrous sheet, and usually takes place after the fibers are formed into a sheet.

The dyeing method employed by the present invention includes both the single-bath and multi-bath dyeing methods. The main feature of the above method and the action which occurs during the process are as follows:

In the single-bath dyeing method, the period of which may be short, it is necessary to allow selection of dyestuff and the use of reserve printing and suspending agents, because a problem arises from the formation of precipitates produced by the interaction between the different types of dyestuff and the resulting contamination. However, imperfect removal of the contaminated dyes affects the lightness of color and fastness of the dyeing which restricted the quality of extremely deep and light colors, and their vividness. In the multi-bath dyeing method, in which a different type of dyestuff is used in a separate bath, there is no danger of precipitate formation from dyestuff reactions, and there is also an advantage that lightness shades and high fastness of dyeing colors can be obtained by employing the so-called intermediate cleaning process which cleans the fibers on the contamination side. The so-called single-bath, multi-step dyeing method, which is included in the single-bath dyeing method in the present invention, produces intermediate result between the single-bath and multi-bath dyeing methods. Any method mentioned above is conventional and the dyeing of the present invention is carried out in this way. It is necessary, however, to select a combination of dyestuffs which cause dyeing in multicolors as defined below. When two different fiber samples are removed from the base and they show a difference in dominant wave length of not shorter than about 5 mμ, preferably not shorter than about 10 mμ, measured by a color difference meter, the fiber is said to have a clear multicolor effect. What a difference in dominant wave length is not greater than about 5 mμ and there is a remarkable difference in color concentration, these should also be included in the so-called multicolor of the present invention. The criterion states that two types of mixed colored fibers must be distinguished easily with the naked eye.

Resins to be used in the coating layer of the present invention include polyurethane, polyurethane urea, polyacrylic acid, polyacrylic ester, polyamino acid, polyamide, polyvinyl acetate, polyvinyl chloride and these blends and copolymers, preferably polyurethane, polyurethane urea, polyacrylic ester and polyamino acid as main components.

In the said coating layer, it is important that light-rays passing through from the coating surface and be reflected with refraction at the surface of the substrate layer to produce the different color spot effect. The coating layer must either be colorless and transparent or colored and transparent, and the thickness of the layer is preferably between the least thickness capable of forming continuous layers and about 100 microns, more preferably between about 0.1 and about 100 microns.

The colored-transparent coating layer is made of a coating composition in which resins are mixed with pigments and/or dyestuffs, and the proportion of the coating composition should be held to not more than about 30 parts for about 100 parts of the resin solid, preferably between about 0.1 and about 10 parts. It is naturally allowable to add to the coating composition, ultraviolet absorbers, antioxidants, gas discoloration inhibitors, and delustering agents to the extent that these do not defeat the object of the present invention.

Uniting the coating layer with the substrate sheet is carried out as follows:

(1) A releasable substrate with a grain pattern or smooth is coated with the coating composition and allowed to dry completely. A second coat is applied and bonded to one side of the fibrous substrate before the coating loses its viscosity, and then is stripped off after drying, or later the resulting product is subjected to surface finishing with a gravure roll.

(2) A releasable substrate similar to (1) is coated with the coating composition, and bonded to one side of the fibrous substrate before the coating loses its viscosity, then is stripped off after drying, or later the resulting product is subjected to surface finishing with a gravure roll.

(3) One side of the fibrous substrate is directly coated by a combination of knife, reverse roll coater, gravure coater, etc., and allowed to dry.

(4) One side of the non-dyeing raw fibrous substrate receives the coating in the same manner as (1) to (3) and is dyed, or later the resulting product is finished by a gravure roll.

Furthermore this coating may be done in a single step or multistep and variation of the degree of coloring at each step makes it possible to produce colors with different hues and/or lightnesses on the same fibrous substrate. In this case, the compounding proportion of the pigment is preferably decreased in successive upper layers. In the multistep coating, different resins may be used when the adhesive strength between the layers is not lower than about 0.5 kg/cm, preferably not lower than about 1.0 kg/cm.

FIG. 1 shows a model of the surface cross section of the artificial grain leather having different color spot groups of the present invention, where A indicates the colored ultra fine composite fiber, B indicates the other colored fiber, C indicates colored or uncolored binder, D indicates the colored-transparent coating layer, E indicates the non-uniform grain pattern surface produced by embossing, crumpling, or grain pattern of release paper, the arrows A+D(+E), C+D(+E) and B+D(+E) show that incidental and reflected angles of light and coloration varies from portion to portion.

The method to enhance the effect of the present invention and to obtain a strong artificial grain leather having high vividness of color, is described as follows.

Figure 2:
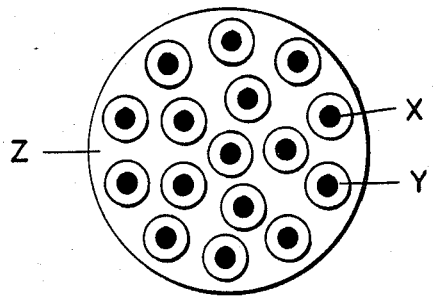
FIG. 2 shows an example of the cross section of ultra fine composite fiber bundles provided by the present invention.
Figure 3:
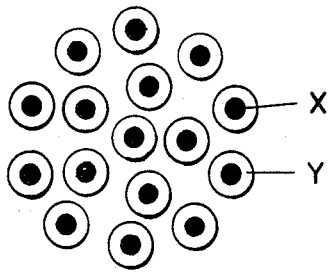
FIG. 3 shows an example of the cross section of the ultra fine composite fibers with the core-sheath type structure provided by the present invention.
Figure 4:
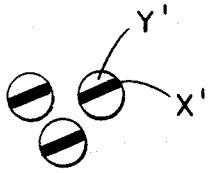
FIG. 4 and 5 show examples of the cross section of an ultra fine composite fibers with the conjugating and the conjugated type structure, respectively, provided by the present invention.
Figure 5:
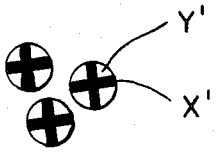

To achieve the above objectives, the tri-component type composite fiber, composed of the island component consisting of the surrounding component and the other component, which is unified by the sea component, is used as shown in FIGS. 3 to 5. FIG. 2 shows the islands-in-a-sea type composite fiber of the core-sheath type. In this case, X which is the core of the island is polyethylene terephthalate with an extremely high degree of polymerization, polybutylene terephthalate or its copolymer. However, the X contains no or a very little 5-sodium sulfoisophthalate, the amount being less than Y. Usually, polyethylene terephthalate or polybutylene terephthalate homopolymer is preferred.

On the other hand, Y is polyester containing 5-sodium sulfoisophthalate unit. In particular, Y is preferably a copolymer with X component. The copolymerizing proportion of 5-sodium sulfoisophthalate is preferably between about 1.5 mol percent and about 4.0 mol percent, more preferably between about 2 mol percent and about 2.8 mol percent. The proportion is represented by amount with respect to the total amount of the acid component. The Y component is allocated to the sheath of the island component, and surrounds the greater part of the side of the core component, preferably not less than about 80%, and more preferably about 100%.

The less the core is covered by the sheath, the poorer is the coloration.

The copolymer component of the above-mentioned sheath component shows a remarkably high apparent viscosity on melting as compared with the intrinsic viscosity.

On the other hand, it is preferred that core component X have as high a intrinsic viscosity as possible by industrial spinning, in order to produce a sufficient strength. It is required that at least the relation $X>Y$ be held at the intrinsic viscosity, since departure from the said relation prevents the object of the present invention from being achieved. Preferably, X should be larger than Y by about 0.1, especially by not less than about 0.15. The strength is enhanced especially when fiber is drawn enough to obtain a elongation of not more than about 100%, preferably between about 65% and about 10%.

The Z component in FIG. 2 indicates the so-called sea component, which is removed as necessary and the fiber for the present invention is formed as shown in FIG. 3. The present invention does not relate to fibers but to an artificial grain leather consisting of a fibrous substrate layer which contains fiber and elastic substances and coating layer.

Ultra fine composite fiber XY preferably has a denier of not more than about 0.5, especially between about 0.25 and about 0.05. The above value, which influences color fastness, dyeability, touch and hand in relation to the dyestuff, makes the present invention most effective. The ultra fine composite fiber XY need not have a round cross section; the various cross sections may be used as necessary. The intrinsic viscosity is measured, for example, in orthochlorophenol at 25° C. The fiber strength of the ultra fine composite fiber XY used in the present invention is not less than about 3 grams/denier, preferably not less than about 4 grams/denier. In the present invention in which the strength is retained in the core component, the proportion of X in XY is between about 90 and 10% by weight, preferably between about 70 and 30% by weight.

Figure 6:
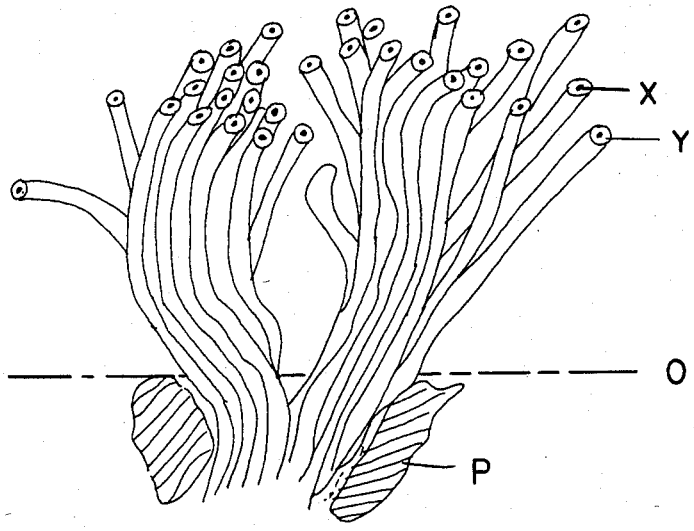
FIG. 6 is a model view showing a raised nap on the fibrous substrate which is made of a nappy material.

FIG. 6 is a model view showing a raised nap on the fibrous substrate which is made of a nappy material. In the figure, O represents the surface of the fibrous substrate without raised nap and P polyurethane elastic substance. It seems that the effect is produced by both the adhesion between P and fiber XY and the coagulation property of P around the fiber, and thus the touch and hand are further improved.

The process following the construction of the fibrous substrate in the above manner is the same as described earlier. Thus the obtained artificial grain leather has a multicolor effect as well as high strength with an excellent vividness in color.

It is not enough for the artificial grain leather of the present invention to be regarded merely as one having colored fine spot groups resulting from the ultra fine fibers and single multicolor spots due to the grouping.

From the synergistic effect of the colored surface layer and additional coloration of the high polymer elastic substance inside the fibrous substrate, the artificial grain leather of the present invention is unique offering the following features: a three-dimensional surface effect; a grain pattern effect caused by fine spots; the same high grade effect as pores resulting from fine spots; a good pores effect, good touch and hand effect caused by blending staples. The multicolor spots mentioned above consist mainly of spots having sizes not larger than about 3 mm, preferably not larger than about 1.5 mm, and more preferably not larger than about 0.8 mm.

The present invention makes it possible to obtain an artificial grain leather having different color spot groups with a three-dimensional surface effect, pores and grain pattern effect, which constitutes an entirely new type not found in the conventional artificial and natural grain leather.

The artificial grain leather having the different color spot groups of the present invention can be used in fields such as clothing, industry, furnishings, wall decorations, interiors, bags and purses, etc. and finds especially effective use in fields where emphasis is on color tint.

Examples relating to the present invention are described below, but the present invention is not limited or restricted by their examples.

EXAMPLE 1

Two types of high molecular arrangement fiber of the islands-in-a-sea type were prepared as follows:

(1) Staple A of 51 mm, comprising the multi-component type fiber in which the island component (the number of islands is 16 pieces): the sea component =60:40, and the island component consists of polyethylene terephthalate containing as copolymer 2.4 mol percent of sodium sulfoisophthalate and the sea component consists of polystyrene copolymerized with 22% by weight of ethylhexyl acrylate, and having 3.8 denier after being spun, drawn and crimped to about 12 crimps/inch.

(2) Staple B of about 51 mm, comprising the multi-component type fiber in which the island component (the number of islands is 16 pieces): the sea component=80:20, the island component consists of polyepsilon caproamide having amino end group, and the sea component consists of polystyrene coopolymerized with 22% by weight of 2-ethylhexyl acrylate styrene, and having 4.5 denier after being drawn and crimped to about 9 to 12 crimps/inch.

A needle-punched felt with nonwoven fabric of about 530 g/m$^2$ was obtained by subjecting these types of staple to the following treatments; staple mixing, sufficient opening, carding, cross-lapping, and ultra-high density needle punching of 3500/cm$^2$. The resulting product was placed in a hot bath of 12% partially saponified polyvinyl alcohol, and simultaneously shrunk and sized. Then, the product was placed in hot air and dried. The hardened sheet like a plastic-like plate was further passed through a trichloroethylene cleaning unit, and was again dried after the sea component of both A and B fibers had been almost completely removed. The resulting product was impregnated with 12% polyurethane dimethyl formamide solution (to which 0.5% of carbon was added), and was coagulated in a dimethyl formamide aqueous coagulating solution. The product was further thoroughly cleaned in hot water, which removed the previously applied sizing agent and dimethyl formamide solvent, followed by drying and then slicing into two. The original surface was further subjected to buffing by a belt sander. As a result, the non-dyeing raw fibrous substrate for the artificial leather having a good suede like was obtained.

The above-mentioned product was dyed as follows:

(1) Single bath dyeing condition (A/B=50/50 on the basis of fiber from which the sea component had been removed) By using cationic dyestuff and acidic dyestuff in the same bath, the dyeing treatment was carried out on the following conditions:

Cathilon Red CD—RLH: 3%
Kayanol Milling Blue GW: 3%
Ospin KB-30F (manufactured by Tokai Seiyu): 4%
Acetic acid (90%): 0.5 cc/l
Anhydrous Glaubers salt: 4.0 g/l
Bath ratio: 1:50
Dyeing Temperature and Time: 120° C.×60 min After dyeing, the contaminated dye was subjected to soaping in the following conditions:

Sandet G-29 (manufactured by Sanyo Kasei): 1.0 g/l
Acetic Acid (90%): 0.5 cc/l
Bath Ratio: 1:50
Treatment Temperature and Time: 70° C.×20 min In order to improve the color fastness of the acid dye, the fixing treatment was carried out in the following conditions:

Nylon Fix TH (manufactured by Nippon Senka Kogyo): 4%
Formic Acid: 1%
Bath Ratio: 1:50
Treatment Temperature and Time: 80° C.×20 min The suede like substrate obtained on the single bath dying condition consists of a mixture or red/blue nap and carbon (black) contained in the impregnated polyurethane present among the red/blue nap. It has three colors different in hues and lightness and a violet and subdued color tone overall.

One side of the above-mentioned fibrous substrate was coated as follows:

A release paper with the basic grain pattern of sheep was coated with a DMF solution of linear type polyurethane in which 2 parts of a prepared pigment consisting of 50% of blue pigment and 50% of polyurethane vehicle had been compounded with 100 parts of solid of polyurethane. After hot air drying the above paper, a coating of about 4.5 microns was produced. The resulting coating was further coated with a DMF/MEK-/ethyl acetate solution of reactive type polyurethane in which 4 parts of the foregoing prepared pigment had been compounded with 100 parts of polyurethane solid, so that the thickness of the coating be about 20 microns. Thus obtained product in a semi-dried state was bonded to the sliced surface of the substrate, passed through rollers with a gap of 0.15 mm to weld the surface, and then dried with hot air. After aging at 30° C. for 24 hours, the release paper was stripped off. The obtained coated product was an artificial grain leather having the deep different color spot groups, into which light penetrates through the transparent colored resin layer which differs in lightness from the blue color of the substrate, and is refracted in different ways from the red, blue and black portions of the fibrous substrate. It was found that the above-mentioned artificial grain leather consisted of spot group colored deeply not larger than 3 mm in size.

When the product was subjected to crumpling, the grain pattern is produced by the different color spot groups, the crumpling grain pattern, and basic grain pattern of sheep mixed with one another, and the resulting unevenness of the surface further enhanced the feature of the present invention.

For determination of the durability of the different color spot groups, the surface abrasion resistance was measured. In a conventional coating on a coating layer applied by a print roll, the printed portion is removed easily but the coating of the present invention showed a high durability which it retained until the coating layer was broken.

EXAMPLE 2

The non-dyeing raw fibrous substrate in Example 1 was dyed as follows:

(2) Double bath dyeing condition (A/B=10/90 on the basis of fiber from which the sea component had been removed)

The sodium sulfoisophthalate-copolymerizing polyethylene terephthalate side was dyed using cation dyestuff in the following conditions:

Cathilon Black CD—BLH: 18%
Ospin KB−30 F: 4%
Acetic Acid: 0.5 cc/l
Anhydrous Glauber's Salt: 4.0 g/l
Bath Ratio: 1:50
Dyeing Temperature and Time: 120° C.×60 min After dyeing of the sodium sulfoisophthalate-copolymerizing polyethylene terephthalate side, for the purpose of removing the contaminated cationic dyestuff on the polyepsilon capramide side, cleaning was done on the following conditions:

Hydrosulfite: 2.0 g/l
Soda Ash 1.0 g/l
Sandet G—29 1.0 g/l
Bath Ratio 1:50
Treatment Temperature and Time 70° C.×20 min Next, the polyepsilon capramide was dyed using acid dye in the following conditions:

Mitsui Nylon Black GL: 2%
Ospin KB—30 F: 4%
Ammonium Sulfate: 4 g/l
Bath Ratio: 1:50
Dyeing Temperature and Time: 98° C.×60 min After dyeing, soaping was carried out in the following conditions:

Sandet G—29: 1.0 g/l
Acetic Acid: 0.5 cc/l
Bath Ratio: 1:50
Treatment Temperature and Time: 70° C.×20 min The suede-like fibrous substrate obtained in the double bath dyeing shown in (2) was a mixture of light grey colored nap and black colored nap, with two degrees of color lightness, and presented a grey and subdued color tone overall.

One side of the fibrous substrate was then coated as follows:

Smooth release paper with no grain pattern was coated with a IPA/DMF solution of linear type non-yellowing polyurethane, and a coating of 7 microns was prepared in the same manner as in Example 1. Thus obtained coating was further coated with a DMF/MEK/toluene solution of reactive type non-yellowing polyurethane to a thickness making the coating 15 microns thick. As in Example 1, the resulting paper was bonded to the fibrous substrate, welded on, dried in hot air, aged, and stripped off. The coated product obtained was an artificial grain leather having deep different color spot groups with different degrees of lightness, into which light-rays penetrated through the transparent colorless resin layer, and refracted in different directions from the light grey and black portions of the fibrous substrate; the grey portion had the appearance of natural grain leather. It was found that no spot was larger than 3 mm.

When subjected to crumpling, the artificial grain leather had a fresh appearance, and a multicolor effect resulting from a combination of crumpling grain pattern with grain pattern produced by the different color spot groups not larger than 3 mm in size.

EXAMPLE 3

Two types of high molecular inter-arrangement fiber having a islands-in-a-sea type cross section was prepared as follows:

(1)
Island component: Polyethylene terephthalate
Sea component: Polystyrene mixed with 5% of PEG
Number of island components: 16
Denier of high molecular inter-arrangement fiber: 3.8
Length of fiber: 51 mm
Number of crimps: About 12 nodes/25 mm
Ratio of island/sea: 38/42

(2)
Island component: Polyethylene terephthalate copolymerized with 2.4 mol percent of 5-sodium sulfoisophthalate
Sea component: Polystyrene
Number of island components: 16
Denier of high molecular inter-arrangement fiber: 3.8
Length of fiber: 51 mm
Number of crimps: About 12 nodes/25 mm
Ratio of island/sea: 79/21

The above-mentioned components were subjected to staple mixing in the ratio of 70 to 30, carding, cross lapping, and needle punching, to produce a needle-punched felt with a texture of 530 g/m$^2$. The resulting product was passed through boiling water, and after drying was passed through a 6% aqueous solution of polyvinyl alcohol mixed with 4% polyurethane emulsion, squeezed through a mangle, and dried. Subsequently, thus product was cleaned with trichloroethylene, after drying being passed through a 12% polyvinyl alcohol aqueous solution, squeezed through a mangle, and dried. The resulting product was further impregnated in a 12% DMF solution of polyurethane, coagulated in DMF-water, and washed with hot water. After drying, the resulting product was sliced in two, buffed, and dyed in the following conditions:

Dyeing Machine: Small-sized fluid dyeing machine
(1) Basic dyestuff
Cathilon Blue CD—RLH (Hodogaya Kagaku): 2.3% owf
Cathilon Yellow RLH (Hodogaya Kagaku): 2.8% owf
Diacryl Red GL—N (Mitsubishi Kasei): 1.4% owf
(2) Disperse Dyestuff
Resolin Blue FBL (Bayer): 0.5% owf
Kayalon Polyester Rubine BLS (Nippon Kayaku): 0.2% owf
Terasil Orange 5RL (Chiba-Geigy): 0.6% owf
Assistant Agent:
Mignol (Ipposha Yushi) 0.5% g/l
Acetic Acid 0.6% g/l
Sodium Acetate 0.3% g/l
Bath Ratio 1:30
Time 2 hr
Temperature 120° C.

After dyeing, reduction cleaning was carried out on the following conditions:

Hydrosulfite: 5% owf
Caustic Soda: 8% owf
Bath Ratio: 1:30
Subsequently, drying was done at 90° C.

The resulting suede-like fibrous substrate presented colors with different lightness values resulting from a mixture of greyish brown colored nap and brown colored nap, and had a soft touch and hand.

The above fibrous substrate was coated as follows:

The linear type non-yellowing polyurethane solution used in Example 2 was mixed in the following proportions with prepared pigments per 100 parts of polyurethane solid.

Black Pigment (Channel Type Carbon Black/Polyurethane vehicle: 25/75): 0.05 parts
White Pigment (Titanium/Polyurethane vehicle: 75/25): 0.195 parts
Yellow Pigment (Insoluble Azo/Polyurethane vehicle: 50/50): 0.02 parts
Brown Pigment (Disazo Condensation Pigment/Polyurethane vehicle: 50/50): 0.03 parts The polyurethane terephthalate film was coated with the resulting compound as in Example 1, and further coated with a reactive type non-yellowing polyurethane solution in said manner. The resulting product was bonded to the other side to the sliced surface. The coated product was an artificial grain leather having different color spot groups in which the lightness values differed from Example 2 and were slightly different between the front and back. A clothing in which the front and back of the above-mentioned product were combined entirely showed a color effect resulting from a combination of the different color spot groups, which was unprecedented.

EXAMPLE 4

The undyed raw fibrous substrate of Example 1 was coated and dyed as follows:

Release paper was coated with acid dye accepting polyurethane so that the thickness of the coating was 30 microns, bonded to the non-dyeing raw fibrous substrate in a semi-dried state and coated as in Example 1. The resulting product was dyed in the same conditions as in Example 1. The product obtained was an artificial grain leather having the same transparent different color spot groups as in Example 1, in which the fibrous substrate surface layer consisted of a mixture of blue and red colored nap with carbon (black) contained in the impregnated polyurethane lying beneath the blue colored film.

EXAMPLE 5

By means of gravure roll (50 mesh), the sliced surface of the fibrous substrate of Example 3 was coated with linear type non-yellowing polyurethane solution, used in Example 3, mixed with a similar pigment, and dried. Subsequently, the resulting product was coated with a coating made from 70% of the above-mentioned pigment by means of gravure roll (80 mesh), and dried. The above product was further coated again with one mixed with 30% of the above-mentioned pigment by means of gravure roll (150 mesh), followed by drying, and an artificial grain leather having the different color spot groups of the present invention was obtained.

EXAMPLE 6

Two types of high molecular inter-arrangement fibers having the islands-in-a-sea type cross section was prepared as follows:

(1) Staple A of tri-component type fiber, having the following composition and property:

X Component: 32 parts by weight of polyethylene terephthalate

Y Component: 25 parts by weight of polyethylene terephthalate containing 5-sodium sulfoisophthalate unit of 2.43 mol/total amount of the acid component Z Component: 43 parts by weight of polystyrene copolymerized with 22 wt percent of 2-ethylhexyl acrylate.

Length and Fineness of Fiber: about 51 mm×3.8 d

Number of Crimps: about 16 crimps/2.54 mm

AB Composite Fiber Strength: about 4.5 g/d (2) Stable B having the following composition:

Island Component: polyethylene terephthalate

Sea Component: polystyrene mixed with 5% PEG

Number of island components: 16

Denier of high molecular inter-arrangement fiber: 3.8

Length of fiber: 51 mm

Number of crimps: about 12 crimps/25 mm

Ratio of island/sea: 38/42

The above-mentioned staples were subjected to staple mixing in a ratio of 30 to 70 (Staple A to Staple B), carding, cross-lapping, and needle punching; a needle-punched felt with a weight of 500 g/m$^2$ was obtained. This felt was passed through boiling water, dried, and then passed through an aqueous solution of 6% polyvinyl alcohol mixed with 4% emulsion polyurethane, squeezed through a mangle, and dried again. Subsequently, the resulting product was cleaned with trichloroethylene, passed through a 12% polyvinyl alcohol aqueous solution after being dried, squeezed through a mangle, and dried again. The resulting product was impregnated in a 12% DMF solution of polyurethane, coagulated in DMF—water, and washed with hot water. The obtained product was sliced into two, then buffed, and subjected to dyeing in the following conditions:

Dyeing Machine: Small-sized Fluid Dyeing Machine (1) Basic Dyestuff

Cathilon Blue CD—RLH (Hodogaya Kagaku): 2.3% owf

Cathilon Yellow RLH (Hodogaya Kagaku): 2.8% owf

Diacryl Red GL—N (Mitsubishi Kasei): 1.4% owf (2) Disperse Dyestuff

Resolin blue FBL (Bayer): 0.5% owf

Kayalon Polyester Rubine BLS (Nippon Kayaku): 0.2% owf

Terasil Orange 5 RL (Chiba Geigy): 0.6% owf

Assistant Agent:

Mignol (Ipposha Yushi): 0.5% g/l

Acetic Acid: 0.6% g/l

Sodium Acetate: 0.3% g/l

Bath Ratio: 1:30

Time: 2 hr

Temperature: 120° C.

After dyeing, reduction cleaning was carried out in the following conditions:

Hydrosulfite: 5% owf

Caustic Soda: 8% owf

Bath Ratio: 1:30

Subsequently, drying was done at 90° C.

The obtained suede-like fibrous substrate displayed colors having various lightness values which resulted from a combination of greyish-brown colored nap and the brown-colored nap, and also had a soft touch and hand.

One side of the above-mentioned fibrous substrate was coated as follows:

Linear type non-yellowing polyurethane solution used in Example 2 was compounded with the following proportions of prepared pigments for 100 parts of polyurethane solid:

Black Pigment (channel type carbon black/polyurethane vehicle: 25/75): 0.05 parts White Pigment (titanium/polyurethane vehicle: 75/25): 0.195 parts Yellow Pigment (insoluble azo/polyurethane vehicle: 50/50): 0.02 parts Brown Pigment (disazo condensation pigment/polyurethane vehicle: 50/50): 0.03 parts The polyethylene terephthalate film was coated with the above compund in the same manner as in Example 1, and further coated with reactive type non-yellowing polyurethane solution in the same way as in Example 2. The resulting product was bonded to the opposite side to the sliced surface. The obtained coated product was an artificial grain leather having the different color spot groups in which the lightness values differed from those of Example 2 and was slightly different from front to back. When the above-mentioned grained surface was viewed through a microscope at a magnification of 80, the fiber forming the different color spot groups was visible through the coating layer. Clothing in which the front and back was of this artificial grain leather displayed a color effect caused by the combination of different color spot groups which was unprecedented.

We claim:

1. An artificial grain leather having fiber bundles and color spot groups differing in hue, lightness value and combinations thereof between adjacent fiber bundles, comprising a fibrous substrate layer and a transparent coating layer on the surface thereof, said transparent coating layer having a grain pattern on the outer surface thereof, said substrate layer comprising ultra fine fibers, bundles of ultra fine fibers and high molecular weight elastomer, and said ultra fine fibers comprising at least two types of ultra fine fiber material having different dyeability which have been dyed with different dyestuffs.

2. An artificial grain leather having different color spot groups as claimed in claim 1, wherein said high molecular polymer layer (B) is colored and transparent.

3. An artificial grain leather having different color spot groups as claimed in claim 1, or 2, wherein the high molecular elastomer constituting said substrate layer is colored.

4. An artificial grain leather having different color spot groups as claimed in claim 1, wherein the fiber constituting said substrate layer consists mainly of ultra fine fibers or ultra fiber bundles of ultra fine fibers, which are not larger than about 0.7 denier.

5. An artificial grain leather having different color spot groups as claimed in claim 1, wherein the fiber constituting said substrate layer consists of a combination of at least two types of fiber different in dyeability.

6. An artificial grain leather having different color spot groups as claimed in claim 1, wherein the fiber constituting said substrate layer is selected from the group consisting of islands-in-a-sea type composite fibers, high molecular inter-arrangement fibers, stripped-off type composite fibers, special polymer blend type fibers and mixtures thereof.

7. An artificial grain leather having different color spot groups as claimed in claim 1, wherein the shape of the cross section of the fiber constituting said substrate layer is selected from the group consisting of round, fan, ellipse, frustrum, cross, hollow, deformed hollow, and fan-like triangular.

8. An artificial grain leather having different color spot groups as claimed in claim 1, wherein said substrate is selected from the group consisting of such materials as woven fabric, knitted fabric, nonwoven fabric, laminates of said materials, and sandwiched forms of said materials.

9. An artificial grain leather having different color spot groups as claimed in claim 1, wherein said high molecular elastomer and transparent coating layer are selected from the group consisting of polyurethane, polyurethane urea, acrylic resin, silicone rubber, fluorine resin, and mixtures of said substances.

10. An artificial grain leather having different color color spot groups as claimed in claim 1, wherein said transparent coating layer with the transparent surface is selected from the group consisting of a single layer and multilayers made up of successive coatings.

11. An artificial grain leather having different color spot groups as claimed in claim 1, wherein the thickness of said transparent coating layer is not larger than about 100 microns.

12. An artificial grain leather having different color spot groups as claimed in claim 1, wherein the ultra fine fibers constituting said substrate layer comprise a surrounding component and another component, said surrounding component covering the greater part of the side of said other component, said surrounding component being a polyester containing 5-sodium sulfoisophthalate units, said other component selected from the group consisting of a component containing no 5-sodium sulfoisophthalate unit and a component containing only a smaller quantity of 5-sodium sulfoisophthalate than said surrounding component, said other component being a polyester selected from the group consisting mainly of ethylene terephthalate units and butylene terephthalate units, and said other component having a larger intrinsic viscosity than said surrounding component.

* * * * *